US009027926B2

(12) United States Patent
Asaka

(10) Patent No.: US 9,027,926 B2
(45) Date of Patent: May 12, 2015

(54) SHEET CONVEYANCE DEVICE, AND IMAGE FORMING APPARATUS HAVING THE SAME

(71) Applicant: KYOCERA Document Solutions Inc., Osaka-shi, Osaka (JP)

(72) Inventor: Hitoshi Asaka, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/141,357

(22) Filed: Dec. 26, 2013

(65) Prior Publication Data

US 2014/0191468 A1 Jul. 10, 2014

(30) Foreign Application Priority Data

Jan. 8, 2013 (JP) ..... 2013-001435

(51) Int. Cl.
*B65H 9/00* (2006.01)
*B65H 5/06* (2006.01)
*B65H 7/02* (2006.01)

(52) U.S. Cl.
CPC ..... *B65H 5/062* (2013.01); *B65H 2557/352* (2013.01); *B65H 2513/511* (2013.01); *B65H 7/02* (2013.01); *B65H 9/006* (2013.01); *B65H 2513/50* (2013.01); *B65H 2513/53* (2013.01); *B65H 2557/63* (2013.01); *B65H 2701/1311* (2013.01)

(58) Field of Classification Search
CPC ..... B65H 9/006; B65H 2511/242; B65H 2553/82; B65H 2557/35; B65H 2557/352; B65H 2513/50; B65H 2513/512; B65H 2513/53; B65H 2513/511; G03G 15/6564; G03G 2215/00599
USPC ..... 271/242, 258.01, 258.03; 399/394
See application file for complete search history.

(56) References Cited

U.S. PATENT DOCUMENTS

| | | | | |
|---|---|---|---|---|
| 8,752,828 | B2 * | 6/2014 | Nakamura et al. | 271/242 |
| 2007/0041762 | A1 * | 2/2007 | Ishida et al. | 399/388 |
| 2008/0231220 | A1 * | 9/2008 | Tsujimoto et al. | 318/476 |
| 2012/0248677 | A1 * | 10/2012 | Nakamura et al. | 271/3.18 |

FOREIGN PATENT DOCUMENTS

JP 09175693 A 7/1997

* cited by examiner

*Primary Examiner* — Michael McCullough
(74) *Attorney, Agent, or Firm* — Alleman Hall McCoy Russell & Tuttle LLP

(57) ABSTRACT

A sheet conveyance device includes conveying portion, first sensing portion, second sensing portion, drive control portion, response time calculation portion, and setting time changing portion. First sensing portion is disposed upstream conveying portion in conveyance direction. Second sensing portion is disposed downstream conveying portion in conveyance direction. Drive control portion makes conveying portion stop until a predetermined setting time has elapsed after sensing of the leading end of the sheet-like member in the conveyance direction of the sheet-like member by first sensing portion, to deflect the sheet-like member, and outputs a drive signal that drives the conveying portion when setting time has elapsed. Response time calculation portion calculates response time until conveying portion is driven since drive signal is outputted. Setting time changing portion changes setting time based on response time calculated by response time calculation portion.

16 Claims, 5 Drawing Sheets

SHEET CONVEYANCE DEVICE, AND IMAGE FORMING APPARATUS HAVING THE SAME

INCORPORATION BY REFERENCE

This application is based upon and claims the benefit of priority from the corresponding Japanese Patent Application No. 2013-001435 filed on Jan. 8, 2013, the entire contents of which are incorporated herein by reference.

BACKGROUND

The present disclosure relates to a sheet conveyance device capable of conveying a sheet-like member, and an image forming apparatus having the sheet conveyance device.

In image forming apparatuses such as a printer, a copying machine, a facsimile machine, and a multifunction peripheral having these functions, a sheet conveyance device for conveying a print paper sheet (sheet-like member) is provided. In a conventional sheet conveyance device, a registration roller pair is provided for subjecting a print paper sheet to a registration operation (also called registration). Here, the registration operation means an operation of applying a conveyance force in the conveyance direction to the print paper sheet while the leading end of the print paper sheet is in abutment against a nip portion of the registration roller pair in a stop state. By this registration operation, inclination of the print paper sheet under conveyance is corrected. Also it becomes possible to align an image formation position in the print paper sheet with a transfer position of an image to be transferred to the print paper sheet.

Upon execution of the registration operation, the print paper sheet is deflected just before the registration roller pair. In a conventional sheet conveyance device, the registration roller pair is driven to rotate at such a timing that the defection is not excessively large, and the print paper sheet is conveyed downstream in the conveyance direction of the print paper sheet. However, a certain response time is required until the registration roller pair is actually driven after a drive signal for the registration roller pair is outputted. This response time is caused by various time loss such as transmission loss in a drive transmission mechanism (gear, clutch or the like) to the registration roller pair. Delay in drive of the registration roller pair due to the response time results in delay in conveyance of the print paper sheet, and as a result, deflection of the print paper sheet can excessively increase. In such a case, the deflected portion of the print paper sheet can collide with a guide surface of a sheet conveyance path to generate collision sound that is uncomfortable to the user. There is known a device that prevents generation of collision sound by reducing the conveyance speed of the print paper sheet in such a situation that collision sound is generated. However, in this device, the abutment of the print paper sheet to the registration roller pair is insufficient due to reduction in conveyance speed although generation of collision sound can be prevented. Therefore, inclination of the print paper sheet cannot always be corrected satisfactorily. Also, it is impossible to achieve speed-up of the image formation.

As a method for preventing generation of collision sound by deflection of a print paper sheet, there is known a method of measuring the response time in advance, and driving the registration roller pair by outputting a drive signal at the timing taking into account the response time. However, the response time varies from device to device, and can change owing to the deteriorated condition of the drive transmission mechanism, duration of use of the device and so on. Such variation or change in the response time will cause change in the amount of deflection of a print paper sheet during the registration operation, and the increased amount of deflection will cause generation of collision sound. In other words, even if the registration roller pair is driven at the timing taking into account the response time, it is impossible to securely prevent generation of collision sound in every sheet conveyance device under various environments.

SUMMARY

A sheet conveyance device according to one aspect of the present disclosure includes a conveying portion, a first sensing portion, a second sensing portion, a drive control portion, a response time calculation portion, and a setting time changing portion. The conveying portion is driven by a drive force transmitted from a drive source to convey a sheet-like member. The first sensing portion is disposed upstream the conveying portion in a conveyance direction of the sheet-like member, and senses a leading end of the sheet-like member in the conveyance direction of the sheet-like member conveyed toward the conveying portion. The second sensing portion is disposed downstream the conveying portion in the conveyance direction of the sheet-like member, and senses a leading end of the sheet-like member in the conveyance direction of the sheet-like member conveyed by the conveying portion. The drive control portion makes the conveying portion stop until a predetermined setting time has elapsed after sensing of the leading end of the sheet-like member in the conveyance direction of the sheet-like member by the first sensing portion, to deflect the sheet-like member, and outputs a drive signal that drives the conveying portion when the setting time has elapsed. The response time calculation portion calculates a response time until the conveying portion is driven since the drive signal is outputted, based on an elapsed time until the leading end of the sheet-like member in the conveyance direction of the sheet-like member is sensed by the second sensing portion since the drive signal is outputted, and a conveyance time required for the sheet-like member to be conveyed a distance from the conveying portion to the second sensing portion. The setting time changing portion changes the setting time based on the response time calculated by the response time calculation portion.

An image forming apparatus according to another aspect of the present disclosure includes a conveying portion, a first sensing portion, a second sensing portion, a drive control portion, a response time calculation portion, a setting time changing portion, and an image forming portion. The conveying portion is driven by a drive force transmitted from a drive source to convey a sheet-like member. The first sensing portion is disposed upstream the conveying portion in a conveyance direction of the sheet-like member, and senses a leading end of the sheet-like member in the conveyance direction of the sheet-like member conveyed toward the conveying portion. The second sensing portion is disposed downstream the conveying portion in the conveyance direction of the sheet-like member, and senses a leading end of the sheet-like member in the conveyance direction of the sheet-like member conveyed by the conveying portion. The drive control portion makes the conveying portion stop until a predetermined setting time has elapsed after sensing of the leading end of the sheet-like member in the conveyance direction of the sheet-like member by the first sensing portion, to deflect the sheet-like member, and outputs a drive signal that drives the conveying portion when the setting time has elapsed. The response time calculation portion calculates a response time until the conveying portion is driven since the drive signal is outputted, based on an elapsed time until the leading end of the sheet-like member in the conveyance direction of the sheet-like member is sensed by the second sensing portion since the drive signal is outputted, and a conveyance time required for the sheet-like member to be conveyed a distance from the conveying portion to the second sensing portion. The setting time changing portion changes the setting time based on the response time calculated by the response time calculation portion. The image forming portion forms an image on the sheet-like member conveyed by the conveying portion driven by the drive control portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 2A and FIG. 2B are views showing the configuration of the image forming apparatus, wherein FIG. 2A is a schematic section view, and FIG. 2B is a detailed section view.

DETAILED DESCRIPTION

Hereinafter, an embodiment of the present disclosure will be described. The embodiment described hereinafter is merely one example embodying the present disclosure, and the embodiment of the present disclosure may be appropriately modified as far as it does not depart from the subject matter of the present disclosure. In the following description, on the basis of the state that an image forming apparatus 10 is placed in an usable manner (the state of FIG. 1), an up-down direction 6 is defined, and a front-back direction 7 is defined with the front side (front face side) being front, and a right-left direction 8 is defined for the image forming apparatus 10 seen from the front side (front face side).

[Image Forming Apparatus 10]

Figure 1:
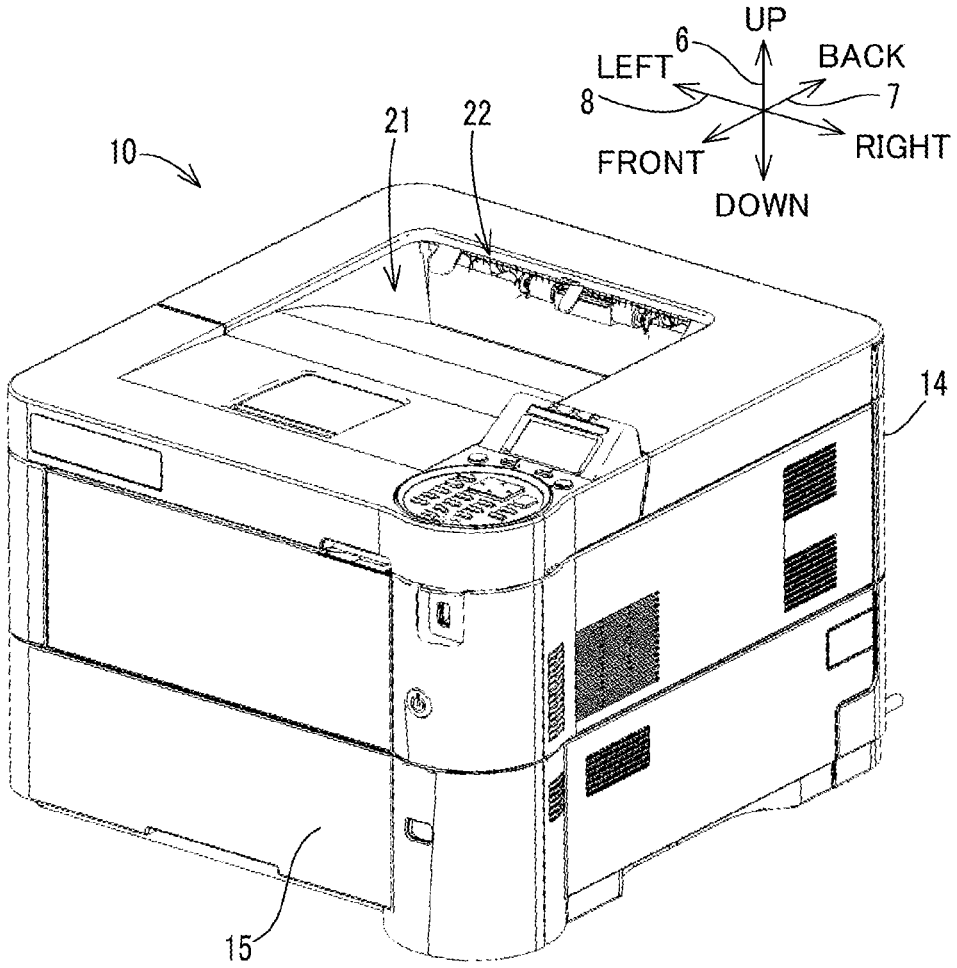
FIG. 1 is a view showing the configuration of the image forming apparatus according to an embodiment of the present disclosure.

The image forming apparatus 10 (one example of an image forming apparatus) shown in FIG. 1 is a printer that prints an input image on a print paper sheet P which is one example of a sheet-like member, using a printing material such as toner. The image forming apparatus 10 is not limited to a printer having only a printing function. The present disclosure is also applicable to, for example, a copying machine or a multifunction peripheral having respective functions of a printer, a facsimile machine, a copying machine and so on.

Figure 2A:
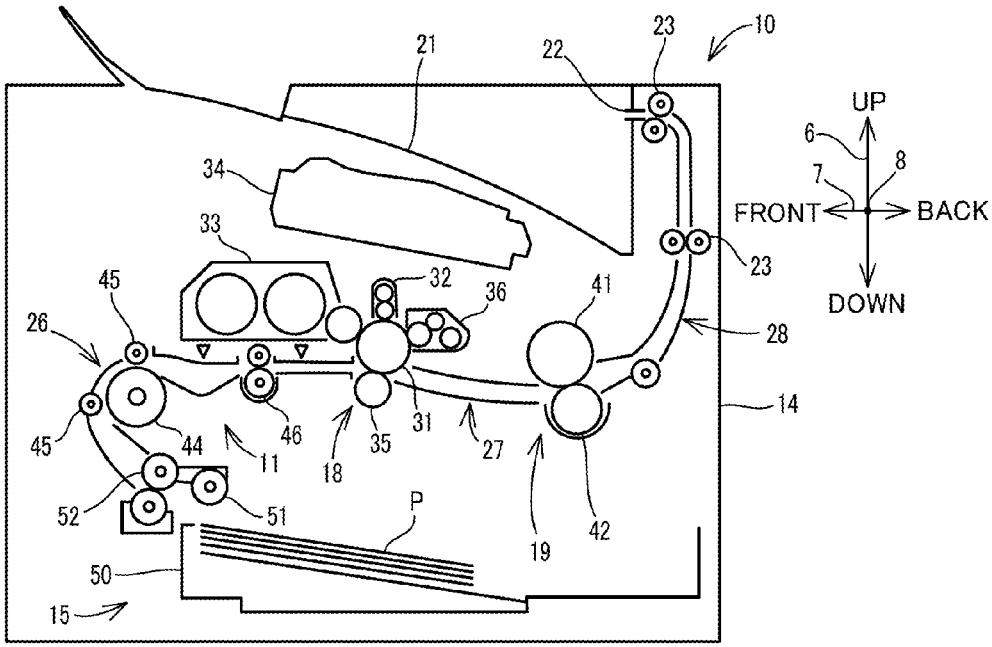
Figure 2B:
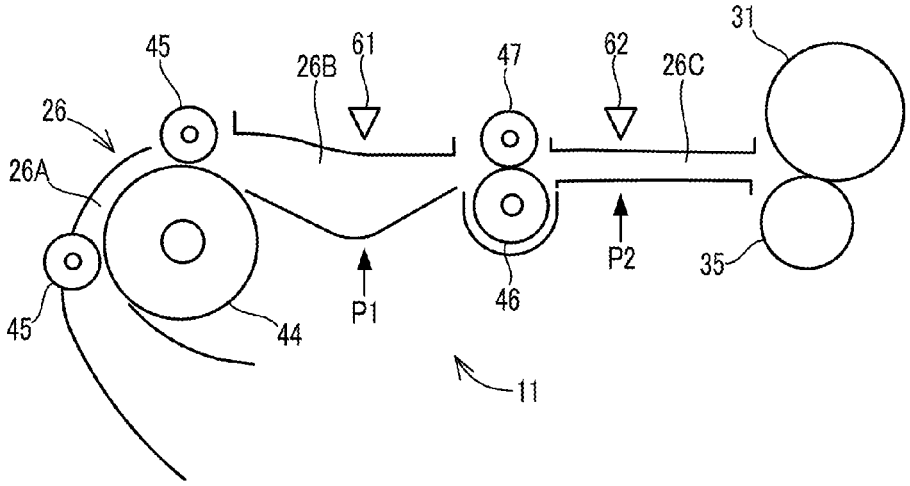

The image forming apparatus 10 prints an image on a print paper sheet P on the basis of image data inputted from outside via a network communication portion that is not illustrated in the drawing. As shown in FIG. 1, FIG. 2A, and FIG. 2B, the image forming apparatus 10 mainly includes an image forming portion 18 adopted the electrophotographic method, a fixing portion 19, a sheet feed device 15, a sheet conveyance mechanism 11 (one example of a sheet conveyance device), and a control portion 90 (see FIG. 3) that generally controls the image forming apparatus 10, and a sheet discharge portion 21. These are disposed inside a housing 14 that forms a cover of the outer frame and the inner frame of the image forming apparatus 10.

As shown in FIG. 2A, the sheet feed device 15 is provided in a lowermost part of the image forming apparatus 10. The sheet feed device 15 includes a sheet feed tray 50, a pickup roller 51, and a sheet feed roller pair 52. The sheet feed tray 50 accommodates a print paper sheet P onto which an image is to be formed by the image forming portion 18, and is supported by the housing 14. The pickup roller 51 and the sheet feed roller pair 52 are provided over a front part of the sheet feed tray 50. Upon input of an instruction for the image forming apparatus 10 to start a sheet feeding operation of a print paper sheet P, the sheet feed roller pair 52 and the pickup roller 51 are driven to rotate by a sheet feed motor 56 (see FIG. 3), and a print paper sheet P is fed from the sheet feed tray 50. The print paper sheet P fed by the pickup roller 51 is conveyed to a first conveyance path 26 formed on the downstream side of the feed direction of the print paper sheet P by the sheet feed roller pair 52.

In the vicinity of the end of the first conveyance path 26, the image forming portion 18 is provided. The image forming portion 18 forms a toner image on a print paper sheet P on the basis of image date inputted from outside. Concretely, the image forming portion 18 transfers a toner image formed by using toner to the print paper sheet P. The image forming portion 18 includes, as shown in FIG. 2A, a photosensitive drum 31, a charging portion 32, a developing portion 33, a transfer portion 35, a cleaning portion 36, and a LSU (Laser Scanner Unit) 34 as a light exposure portion. Upon starting of an image forming operation, the surface of the photosensitive drum 31 is charged at a uniform potential by the charging portion 32. Further, the LSU 34 scans the charged photosensitive drum 31 with a laser beam in accordance with the image data. As a result, an electrostatic latent image is formed on the photosensitive drum 31. Then toner is adhered to the electrostatic latent image by the developing portion 33, and the toner image is developed on the photosensitive drum 31. Then the toner image is transferred to the print paper sheet P conveyed through the first conveyance path 26 by the transfer portion 35. The print paper sheet P on which the toner image is formed is conveyed to a second conveyance path 27 formed downstream the image forming portion 18 in the conveyance direction of the print paper sheet P.

The second conveyance path 27 extends backward, and is provided with the fixing portion 19 at its end. The print paper sheet P fed out from the image forming portion 18 to the second conveyance path 27 is conveyed to the fixing portion 19 through the second conveyance path 27. The fixing portion 19 fixes the toner image transferred to the print paper sheet P on the print paper sheet P by heat and pressure, and includes a heating roller 41 and a pressurizing roller 42. The heating roller 41 is heated to high temperature by a heating device such as a heater during the fixing operation. While the print paper sheet P passes through the fixing portion 19, the toner forming the toner image is heated to melt by the heating roller 41 of the fixing portion 19, and further pressurized by the pressurizing roller 42. As a result, the toner image is fixed to the print paper sheet P, therefore the image is fixed to the print paper sheet P. The print paper sheet P on which the image is fixed by the fixing portion 19 is conveyed to a third conveyance path 28 formed downstream the fixing portion 19 in the conveyance direction of the print paper sheet P.

The third conveyance path 28 is curved upward from the fixing portion 19 and then extends straight upward in the vertical direction, and is then curved frontward to lead to a sheet outlet 22. In other words, the third conveyance path 28 is formed between the fixing portion 19 and the sheet outlet 22. The third conveyance path 28 is provided with a plurality of sheet discharge roller pairs 23 that are rotated by a conveyance motor 57 (see FIG. 3, one example of a drive source in the present disclosure). The print paper sheet P fed out to the third conveyance path 28 is conveyed upward through the third conveyance path 28 by the sheet discharge roller pairs 23 that are driven to rotate by the conveyance motor 57, and discharged to the sheet discharge portion 21 provided on the top face of the image forming apparatus 10 through the sheet outlet 22.

[Sheet Conveyance Mechanism 11]

Next, referring to FIG. 2A and FIG. 2B, the configuration of the sheet conveyance mechanism 11 will be described. As shown in FIG. 2B, the sheet conveyance mechanism 11 is provided in the vicinity of the first conveyance path 26, and includes mainly a conveying roller 44, a registration roller 46 (one example of conveyance portion and a drive roller), a first sensor 61 (one example of a first sensing portion), and a second sensor 62 (one example of a second sensing portion). The first conveyance path 26 is a conveyance path formed between the sheet feed roller pair 52 and the image forming portion 18, and is formed by conveyance guides that are provided facing to each other. The first conveyance path 26 is composed of a curved path 26A that curves upward from the sheet feed roller pair 52, an intermediate path 26B that extends backward from the end of the curved path 26A to lead to the registration roller 46, and a straight path 26C that leads to the image forming portion 18 from the registration roller 46. The conveying roller 44 and the registration roller 46 are rotatably provided so that their outer peripheries are exposed to the first conveyance path 26.

The conveying roller 44 is driven to rotate by a drive force of the conveyance motor 57 (see FIG. 3) transmitted via a drive transmission mechanism such as a gear that is not illustrated in the drawing. The conveying roller 44 is disposed inside the curved path 26A as shown in FIG. 2B. Outside the outer periphery of the conveying roller 44, two rotary rollers 45 are disposed in contact with the outer periphery of the conveying roller 44, and when the conveying roller 44 is driven to rotate, the rotary rollers 45 are also driven to rotate. The print paper sheet P fed to the curved path 26A by the sheet feed roller pair 52 is conveyed to the intermediate path 26B situated downstream in the conveyance direction of the print paper sheet P, while being nipped by the conveying roller 44 and the rotary rollers 45.

The intermediate path 26B is provided with the first sensor 61. The first sensor 61 is disposed upstream the registration roller 46 in the conveyance direction of the print paper sheet P. The first sensor 61 is provided for sensing a leading end (end part on the downstream side in the conveyance direction of the print paper sheet P) of a print paper sheet P that is conveyed toward the registration roller 46 from upstream of the conveyance direction of the print paper sheet P. The first sensor 61 is used for determining the timing of driving the registration roller 46 to rotate. In other words, it is used for determining a setting time that is a time required for a registration operation to be executed on the print paper sheet P by the registration roller 46 (hereinafter, referred to as "registration time"). The first sensor 61 is, for example, a reflective photo transistor capable of sensing a print paper sheet P passing through the intermediate path 26B, or may be a combination of a sensor that is displaced in accordance with passage of a print paper sheet P, and a transmission type photo transistor whose light path is interrupted or opened in accordance with the displacement of the sensor. The first sensor 61 may have any configuration as long as it can sense the passage position of the leading end of the print paper sheet P conveyed through the intermediate path 26B.

Figure 4:
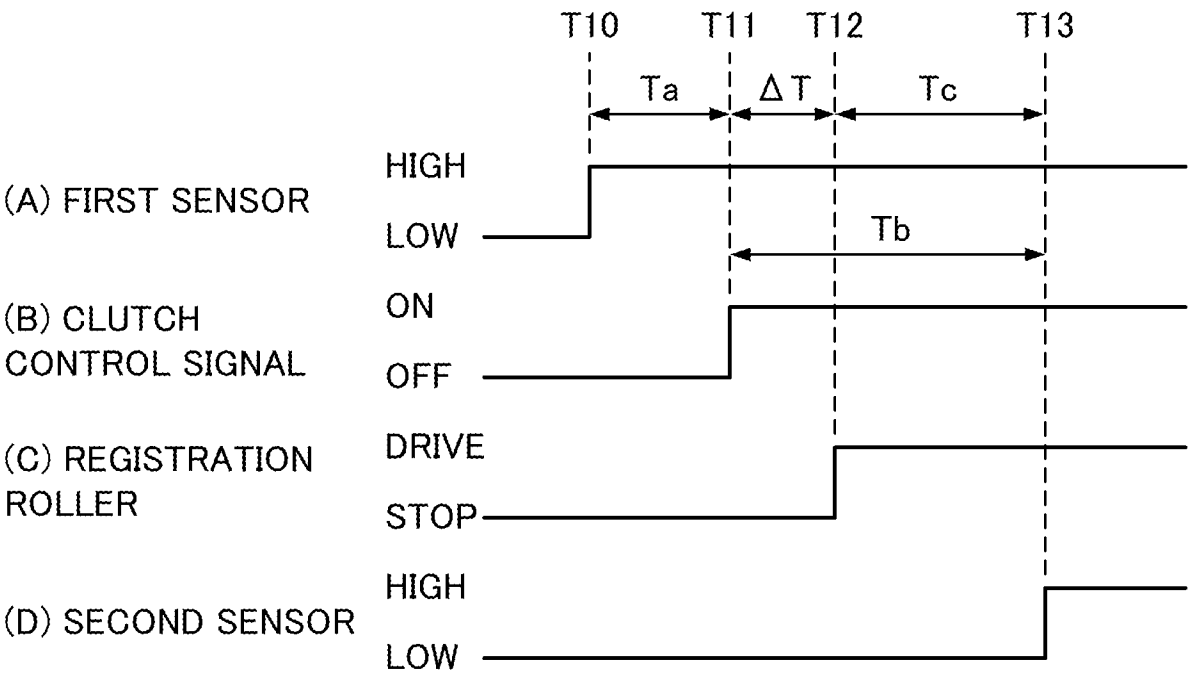
FIG. 4 is a diagram showing the timing chart in the registration process by the control portion in FIG. 3.

When the leading end of the print paper sheet P reaches a sensing position P1 by the first sensor 61, an output signal of the first sensor 61 changes from LOW level to HIGH level as shown in the timing chart (A) of FIG. 4 (see the time point T10 in FIG. 4). The first sensor 61 is connected with the control portion 90, and the control portion 90 determines that the leading end of the print paper sheet P has reached the sensing position P1 by the first sensor 61 when the output signal of the first sensor 61 changes from LOW level to HIGH level.

The registration roller 46 is driven to rotate by a drive force from the conveyance motor 57 (see FIG. 3) to convey the print paper sheet P having reached the registration roller 46 downstream in the conveyance direction of the print paper sheet P. The drive force of the conveyance motor 57 is transmitted to the registration roller 46 via a drive transmission mechanism such as a gear that is not illustrated in the drawing. The registration roller 46 is provided with an electromagnetic clutch 58 (see FIG. 3). The electromagnetic clutch 58 is connected with the control portion 90, and interrupts or connects the drive path from the conveyance motor 57 to the registration roller 46 by being turned ON (fitted-in) or OFF (pulled-off) according to the control signal (ON signal or OFF signal) outputted from the control portion 90. In the present embodiment, the rotary drive of the registration roller 46 is controlled by the control of the electromagnetic clutch 58 by the control portion 90.

The registration roller 46 is provided between the intermediate path 26B and the straight path 26C. The registration roller 46 is a long roller member extending straight in the direction perpendicular to the conveyance direction (right-left direction 8 of the image forming apparatus). Outside the outer periphery of the registration roller 46, a plurality of rotary rollers 47 (one example of a driven roller in the present disclosure) are disposed in contact with the outer periphery of the registration roller 46, and when the registration roller 46 is driven to rotate, the rotary rollers 47 are also driven to rotate. The registration roller 46 is used both for conducting a registration operation on the print paper sheet P conveyed through the intermediate path 26B, and for conveying the print paper sheet P, having experienced the registration operation, downstream in the conveyance direction of the print paper sheet P. Concretely, after a lapse of a predetermined registration time Ta (see FIG. 4) from sensing of the leading end of the print paper sheet P by the first sensor 61, a drive force is transmitted to the registration roller 46 in a stop state. During the period until the drive force is transmitted, the leading end of the print paper sheet P is brought into abutment against a nip portion between the registration roller 46 and the rotary rollers 47. Upon continuous application of a conveyance force to the print paper sheet P by the conveying roller 44 in this condition, the leading end of the print paper sheet P is registered to follow the longitudinal direction of the registration roller 46. As a result, inclination of the print paper sheet P under conveyance is corrected.

The registration time Ta is set to such a time that the print paper sheet P deflected by the registration operation will not come into abutment against a guide surface of the conveyance guides forming the intermediate path 26B. Essentially, if the registration time Ta is set in this manner, the deflected print paper sheet P will not vigorously collide with a guide surface of the intermediate path 26B to generate collision sound.

However, a response time ΔT required for the electromagnetic clutch 58 to actually operate to rotate the registration roller 46 and then for the registration roller 46 to begin to rotate after input of a drive signal to the electromagnetic clutch 58 (see FIG. 4) varies among individual electromagnetic clutches 58, and also changes by deterioration of the electromagnetic clutch 58 or the drive transmission mechanism and so on. Therefore, when the registration operation is executed with the registration time Ta that is commonly set for every produced image forming apparatus 10, variation arises in the drive start timing of the registration roller 46. Therefore, when the drive start timing of the registration roller 46 is delayed, the deflection amount of the print paper sheet P is so large that the print paper sheet P collies with a guide surface of the conveyance guide to generate uncomfortable collision sound. It is conceivable to increase the conveyance path height or the conveyance path length of the intermediate path 26B in consideration of the change in deflection amount as described above, however, excess increase in the conveyance path height or the conveyance path length is not preferred because it interferes with compactification of the image forming apparatus. For this reason, the present embodiment is configured to change the registration time Ta to appropriate time by conducting a registration time changing process according to the flowchart of FIG. 5 by the control portion 90 as will be described later. A procedure of the registration time changing process will be described later.

The straight path 26C is provided with the second sensor 62. The second sensor 62 is provided downstream the registration roller 46 in the conveyance direction of the print paper sheet P. The second sensor 62 is provided for sensing a leading end of a print paper sheet P conveyed toward the image forming portion 18 from upstream in the conveyance direction of the print paper sheet P by the registration roller 46. The second sensor 62 is used for calculating a response time until the registration roller 46 is actually driven after a drive signal is outputted to the electromagnetic clutch 58. The second sensor 62 has a similar configuration to the first sensor 61. The second sensor 62 may have any configuration as long as it can sense the passage position of the leading end of the print paper sheet P conveyed through the straight path 26C.

When the leading end of the print paper sheet P reaches a sensing position P2 by the second sensor 62, an output signal of the second sensor 62 changes from LOW level to HIGH level as shown in the timing chart (D) of FIG. 4 (see the time point T13 in FIG. 4). The second sensor 62 is connected with the control portion 90, and the control portion 90 determines that the leading end of the print paper sheet P has reached the sensing position P2 by the second sensor 62 when output signal of the second sensor 62 changes from LOW level to HIGH level.

[Control Portion 90]

Figure 3:
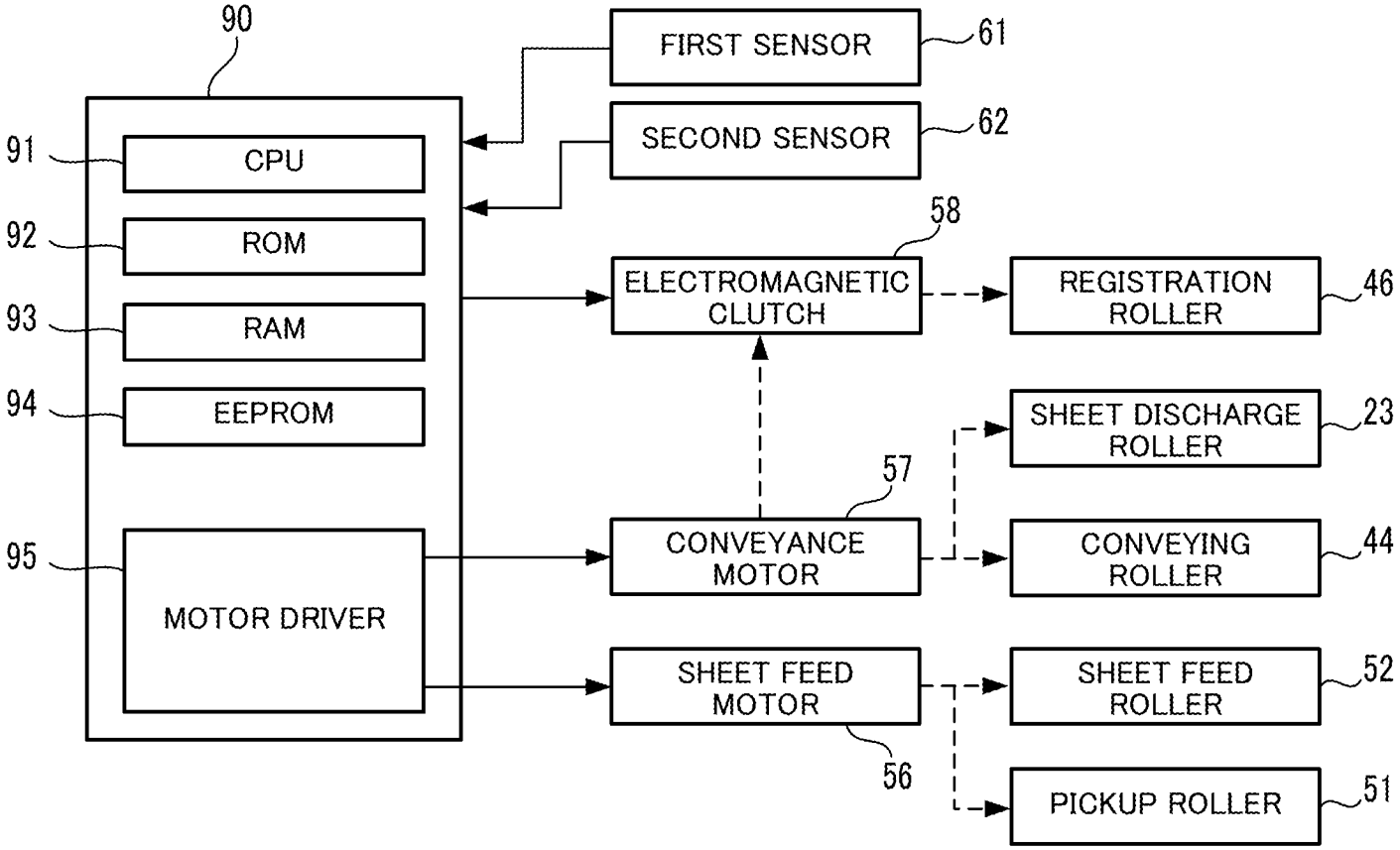
FIG. 3 is a block diagram showing the configuration of the control portion included in the image forming apparatus in FIG. 1.

The control portion 90 generally controls the image forming apparatus 10. As shown in FIG. 3, the control portion 90 is composed of a CPU 91, a ROM 92, a RAM 93, an EEPROM 94, a motor driver 95 and so on. The control portion 90 is electrically connected, via a signal line or the like, with the sheet feed motor 56, the conveyance motor 57, the electromagnetic clutch 58, the first sensor 61, and the second sensor 62. The electromagnetic clutch 58 is drive-controlled by a control signal (ON signal or OFF signal) outputted from the control portion 90. The control portion 90 determines whether the leading end of the print paper sheet P has reached the sensing positions P1 or P2 based on output signals from the first sensor 61 or the second sensor 62. The sheet feed motor 56 and the conveyance motor 57 are connected with the motor driver 95 of the control portion 90, and are drive-controlled by receiving an individual control signal from the motor driver 95.

Figure 5:
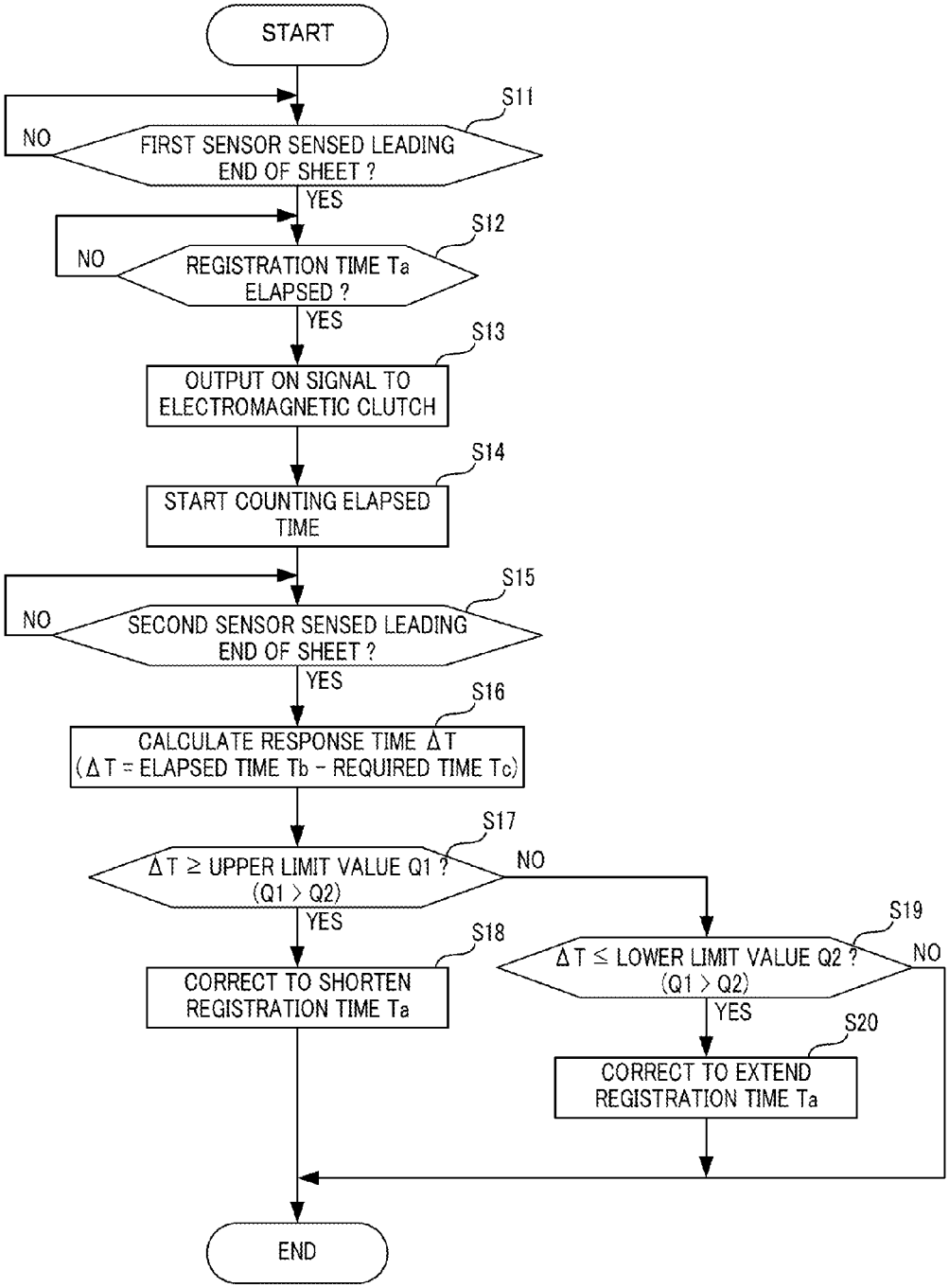
FIG. 5 is a flowchart showing one exemplary procedure of the registration time changing process by the control portion in FIG. 3.

In the present embodiment, the control portion 90 conducts a registration time changing process according to the flowchart of FIG. 5. The registration time changing process is a process for changing the setting of the registration time Ta for the registration operation to an appropriate time (time that does not cause collision sound). The ROM 92 stores a control program for executing the registration time changing process. The EEPROM 94 stores the registration time Ta, and an upper limit value Q1 and a lower limit value Q2 described later for use in the registration time changing process. The EEPROM 94 stores various information used for the registration time changing process, for example, a required time Tc necessary for conveying the print paper sheet P from the registration roller 46 to the sensing position P2 of the second sensor 62. The required time Tc is determined from predetermined information such as a distance from the registration roller 46 to the sensing position P2 and a rotation speed of the registration roller 46. Of course, the control portion 90 may calculate the required time Tc from the distance and the rotation speed as necessary.

The registration time changing process by the control portion 90 may be realized by electronic circuits such as integrated circuits (ASIC, DSP).

[Registration Time Changing Process]

Hereinafter, one example of a procedure of the registration time changing process executed by the control portion 90 will be described by referring to the flowchart of FIG. 5. S11, S12, . . . in FIG. 5 represent the number of processing procedure (step). By execution of the registration time changing process by the control portion 90 according to the procedure, the drive control portion, the response time calculation portion, and the setting time changing portion of the present disclosure are realized.

Upon input of an instruction signal instructing the image forming apparatus 10 to start an image forming operation, the motor driver 95 of the control portion 90 drives the sheet feed motor 56 and the conveyance motor 57 to rotate the pickup roller 51, the sheet feed roller pair 52, the conveying roller 44, and the sheet discharge roller pairs 23. Further, the control portion 90 outputs an OFF signal to the electromagnetic clutch 58 to execute a control of keeping OFF state (pulled-off state) of the electromagnetic clutch 58. As a result, the print paper sheet P is taken out from the sheet feed tray 50 and fed to the curved path 26A of the first conveyance path 26, and further, the print paper sheet P is conveyed to the intermediate path 26B by the conveying roller 44. On the other hand, the registration roller 46 does not rotate because the electromagnetic clutch 58 is in the OFF state. The control portion 90 stops the sheet feed motor 56 when the print paper sheet P has been fed to the position where it is conveyed by the conveying roller 44.

Next, the control portion 90 determines whether the first sensor 61 has sensed the leading end of the print paper sheet P conveyed through the intermediate path 26B (S11). Concretely, the control portion 90 determines that the leading end of the print paper sheet P has reached the sensing position P1 when the output signal of the first sensor 61 changes from LOW level to HIGH level (see the time point T10 in the timing chart (A) of FIG. 4). Here, when it is determined that the first sensor 61 has sensed the leading end of the print paper sheet P, the control portion 90 starts counting of time, and determines whether the predetermined registration time Ta has elapsed after sensing of the leading end of the print paper sheet P (S12).

The control portion 90 continuously drives the conveyance motor 57 to apply a conveyance force to the print paper sheet P conveyed to the intermediate path 26B until the registration time Ta has elapsed. As a result, the registration operation is executed during the registration time Ta, and the leading end of the print paper sheet P is registered in such a way that the leading end of the print paper sheet P is brought into abutment against the nip portion between the registration roller 46 and the rotary rollers 47. At this time, the print paper sheet P is deflected within the intermediate path 26B by the registration operation.

When it is determined that the registration time Ta has elapsed in step S12, the control portion 90 outputs an ON signal to the electromagnetic clutch 58 (see the time point T11 in the timing chart (B) of FIG. 4) in the next step S13.

In other words, in step S12 and step S13, the control portion 90 stops the registration roller 46 until the registration time Ta has elapsed after sensing of the leading end of the print paper sheet P by the first sensor 61, to cause deflection of the print paper sheet P in the intermediate path 26B, and outputs an ON signal for driving the registration roller 46 to the electromagnetic clutch 58 when the registration time Ta has elapsed.

Upon input of the ON signal to the electromagnetic clutch 58, the electromagnetic clutch 58 is driven and the electromagnetic clutch 58 is switched from OFF state to ON state (inserted state). When the ON signal is outputted to the electromagnetic clutch 58, and the electromagnetic clutch 58 is switched to ON state, a drive force from the conveyance motor 57 is transmitted to the registration roller 46, and the registration roller 46 rotates. However, actually, the registration roller 46 does not rotate immediately after the ON signal is outputted to the electromagnetic clutch 58, but as shown in the timing chart (C) of FIG. 4, rotation of the registration roller 46 starts after a lapse of the response time ΔT including the operation time of the electromagnetic clutch 58 and transmission loss of a drive transmission mechanism that is not illustrated in the drawing (see the time point T12).

In step S13, upon output of an ON signal from the control portion 90, the control portion 90 starts counting an elapsed time from output of an ON signal (S14). This counting of the lapse time is continued until the leading end of the print paper sheet P is sensed by the second sensor 62.

Subsequently, the control portion 90 determines whether the second sensor 62 has sensed the leading end of the print paper sheet P conveyed through the straight path 26C (S15). Concretely, when the output signal of the second sensor 62 changes from LOW level to HIGH level, the control portion 90 determines that the leading end of the print paper sheet P has reached the sensing position P2 (see the time point T13 in the timing chart (D) of FIG. 4). Here, when it is determined that the second sensor 62 has sensed the leading end of the print paper sheet P, the control portion 90 stops the counting in step S13 and stores the time counted by that time, namely an elapsed time Tb from the time point T11 to the time point T13 in FIG. 4 in the RAM 93 of the control portion 90.

Then in step S16, the control portion 90 calculates the response time ΔT that is required for the registration roller 46 to actually rotate to start conveyance of the print paper sheet P from output of the ON signal to the electromagnetic clutch 58. Concretely, the control portion 90 calculates the response time ΔT based on the lapse time Tb stored in the RAM 93 in step S15, and the required time Tc stored in the EEPROM 94. More specifically, the control portion 90 calculates the value obtained by subtracting the required time Tc from the lapse time Tb, as the response time ΔT (=Tb−Tc).

In other words, in steps S14 to S16, the control portion 90 calculates the response time ΔT from output of the ON signal to start of rotation of the registration roller 46, based on the lapse time Tb until the leading end of the print paper sheet P is sensed by the second sensor 62 after the ON signal is outputted, and the required time Tc required for the print paper sheet P to be conveyed to the sensing position P2 by the second sensor 62 from the registration roller 46.

The response time ΔT calculated in step S16 is an actual response time ΔT in the image forming apparatus rather than an estimate value. If this response time ΔT falls within a predetermined allowable range (Q2<ΔT<Q1), the deflection amount of the print paper sheet P in the intermediate path 26B will not be too large even when a registration operation of the registration time Ta is executed, and deficient inclination correction for the print paper sheet P due to insufficient registration operation will not occur. Here, the allowable range is determined by factors including, for example, the conveyance path height and the conveyance path length in the intermediate path 26B. In the present embodiment, an upper limit value Q1 (one example of a first threshold in the present disclosure) of the allowable range for the response time ΔT is set at a limit value at which collision sound starts emanating because starting of rotation of the registration roller 46 is so delayed that the defection of the print paper sheet P exceeds the allowable amount. A lower limit value Q2 (one example of a second threshold in the present disclosure) of the allowable range for the response time ΔT is set at a limit value at which correction of inclination becomes insufficient because start of rotation of the registration roller 46 is so early that the registration operation for the print paper sheet P is insufficient.

After the response time ΔT is calculated in step S16, the control portion 90 executes a process of changing the set value of the registration time Ta required for the registration operation based on the calculated response time ΔT.

Concretely, the control portion 90 compares the response time ΔT and the upper limit value Q1 in step S17 to determine whether the response time ΔT is longer than or equal to the upper limit value Q1. Here, when it is determined that the response time ΔT is longer than or equal to the upper limit value Q1, the control portion 90 corrects the set value of the registration time Ta to shorten (S18). In other words, the control portion 90 changes the set value of the registration time Ta to a smaller value by a specific amount so that the registration time Ta is shorter by a specific time, and updates the set value of the registration time Ta in the EEPROM 94. Concretely, the control portion 90 makes the set value of the registration time Ta shorter by a time difference between the response time ΔT and the upper limit value Q1, namely by a value obtained by subtracting the upper limit value Q1 from the response time ΔT. Then, the processing sequence ends. When the response time ΔT is longer than or equal to the upper limit value Q1 as described above, deflection of the print paper sheet P in the intermediate path 26B exceeds the allowable amount, and collision sound by the deflection can occur, and hence, in step S18, correction is made so that the registration time Ta is shorter. Therefore, it is always possible to control the deflection of the print paper sheet P to less than the allowable amount. As a result, deflection is prevented from excessively increasing, and generation of collision sound due to deflection is also prevented. Further, since the registration time Ta is shortened by a time difference between the response time ΔT and the upper limit value Q1, it is possible to securely make the response time ΔT fall within the allowable range. As a result, it becomes possible to always set the registration time Ta at an appropriate time.

On the other hand, in step S17, when it is determined that the response time ΔT is shorter than the upper limit value Q1, the control portion 90 compares the response time ΔT and the lower limit value Q2, and determines whether the response time ΔT is shorter than or equal to the lower limit value Q2 in the next step S19. Here, when it is determined that the response time ΔT is shorter than or equal to the lower limit value Q2, the control portion 90 corrects the set value of the registration time Ta to extend (S20). In other words, the control portion 90 changes the set value of the registration time Ta to a larger value by a specific amount so that the registration time Ta is longer by a specific time, and updates the set value of the registration time Ta in the EEPROM 94. Concretely, the control portion 90 makes the set value of the registration time Ta larger by a time difference between the response time ΔT and the lower limit value Q2, namely by a value obtained by subtracting the response time ΔT from the lower limit value Q2. Then, the processing sequence ends. When the response time ΔT is shorter than or equal to the lower limit value Q2 as described above, inclination of the print paper sheet P can no longer be corrected because of insufficient registration operation on the print paper sheet P, and hence, in step S20, correction is made so that the registration time Ta is longer. Therefore, it is always possible to conduct sufficient registration operation so that inclination of the print paper sheet P will not occur by ensuring the sufficient registration time Ta. Also in this case, since the registration time Ta is extended by a time difference between the response time ΔT and the lower limit value Q2, it is possible to securely make the response time ΔT fall within the allowable range. As a result, it becomes possible to always set the registration time Ta at an appropriate time.

In step S19, when it is determined that the response time ΔT is longer than the lower limit value Q2, or in other words, when the response time ΔT falls within the aforementioned allowable range ($Q2<\Delta T<Q1$), the processing sequence ends while the registration time Ta is not changed.

The registration time changing process executed by the control portion 90 may be executed every time the registration operation is conducted on the print paper sheet P, or may be executed every time a certain time has elapsed or every time the count of printed sheet number reaches a certain number.

While the aforementioned embodiment is configured to control drive transmission to the registration roller 46 by using the electromagnetic clutch 58, the present disclosure is applicable also to a configuration in which the registration roller 46 is individually operated by a drive source such as a motor without using the electromagnetic clutch 58. In such a case, the response time ΔT is a time until the registration roller 46 actually starts rotating from output of the drive signal to the motor.

Further, in the aforementioned embodiment, the registration roller 46 having a long shape extending straight in the direction perpendicular to the conveyance direction (right-left direction 8 of the image forming apparatus) is exemplified, however, the registration roller 46 is not limited to the one having a long shape. For example, the present disclosure is also applicable to such a configuration that a plurality of registration rollers are arranged in line in the same direction.

In the aforementioned embodiment, the second sensor 62 is disposed in the straight path 26C of the first conveyance path 26, however, in the image forming apparatus 10 of the type that alignment between an image formation position in the print paper sheet P and a transfer position of the image to be transferred to the print paper sheet P is conducted for the print paper sheet P in the straight path 26C, a paper sheet sensing portion provided in the straight path 26C for the alignment may be used as an alternative to the second sensor 62.

In the case where an optimum registration time is set for each kind of the print paper sheet P which is an object of printing in the image forming apparatus 10, the control portion 90 may acquire information of the kind of the print paper sheet P (gloss paper, plain paper, postcard etc.) contained in the instruction signal of the image forming operation inputted to the image forming apparatus 10, set the registration time Ta in accordance with the kind, and change the registration time Ta by the registration time changing process as descried above.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveyance device comprising:

a conveying portion configured to be driven by a drive force transmitted from a drive source to convey a sheet-like member;

a first sensing portion disposed upstream the conveying portion in a conveyance direction of the sheet-like member, and configured to sense a leading end of the sheet-like member in the conveyance direction of the sheet-like member conveyed toward the conveying portion;

a second sensing portion disposed downstream the conveying portion in the conveyance direction of the sheet-like member, and configured to sense the leading end of the sheet-like member in the conveyance direction of the sheet-like member conveyed by the conveying portion;

a control portion configured to make the conveying portion stop until a predetermined setting time has elapsed after sensing of the leading end of the sheet-like member in the conveyance direction of the sheet-like member by the first sensing portion, deflects the sheet-like member, and outputs a drive signal that drives the conveying portion when the setting time has elapsed; and wherein the control portion is further configured to:

calculate a response time until the conveying portion is driven since the drive signal is outputted, based on an elapsed time until the leading end of the sheet-like member in the conveyance direction of the sheet-like member is sensed by the second sensing portion since the drive signal is outputted, and a conveyance time required for the sheet-like member to be conveyed a distance from the conveying portion to the second sensing portion; and change a setting time based on the calculated response time, wherein the control portion changes the setting time when the response time is longer than a first threshold that is set as a limit value at which a collision sound by deflection of the sheet-like member starts emanating, and when the response time is shorter than a second threshold that is set as a limit value at which correction of inclination of the sheet-like member due to a stop of the conveying portion becomes insufficient, and does not change the setting time when the response time is within an allowable range in which the response time is equal to or longer than the second threshold and is equal to or shorter than the first threshold.

2. The sheet conveyance device according to claim 1, wherein the control portion shortens the setting time when the response time is longer than or equal to a first threshold.

3. The sheet conveyance device according to claim 2, wherein the control portion shortens the setting time by a time difference between the response time and the first threshold.

4. The sheet conveyance device according to claim 2, wherein the first threshold is an upper limit value of the allowable range for the response time.

5. The sheet conveyance device according to claim 1, wherein the control portion extends the setting time when the response time is shorter than the second threshold.

6. The sheet conveyance device according to claim 5, wherein the control portion extends the setting time by a time difference between the response time and the second threshold.

7. The sheet conveyance device according to claim 5, wherein the second threshold is a lower limit value of the allowable range for the response time.

8. The sheet conveyance device according to claim 1, wherein the control portion shortens the setting time when the response time is longer than the first threshold and extends the setting time when the response time is shorter than the second threshold.

9. An image forming apparatus comprising:

a conveying portion configured to be driven by a drive force transmitted from a drive source to convey a sheet-like member;

a first sensing portion disposed upstream the conveying portion in a conveyance direction of the sheet-like member, and configured to sense a leading end of the sheet-like member in the conveyance direction of the sheet-like member conveyed toward the conveying portion;

a second sensing portion disposed downstream the conveying portion in the conveyance direction of the sheet-like member, and configured to sense the leading end of the sheet-like member in the conveyance direction of the sheet-like member conveyed by the conveying portion;

a control portion configured to make the conveying portion stop until a predetermined setting time has elapsed after sensing of the leading end of the sheet-like member in the conveyance direction of the sheet-like member by the first sensing portion, deflects the sheet-like member, and outputs a drive signal that drives the conveying portion when the setting time has elapsed; and wherein the control portion is further configured to:

calculate a response time until the conveying portion is driven since the drive signal is outputted, based on an elapsed time until the leading end of the sheet-like member in the conveyance direction of the sheet-like member is sensed by the second sensing portion since the drive signal is outputted, and a conveyance time required for the sheet-like member to be conveyed a distance from the conveying portion to the second sensing portion; and change a setting time based on the calculated response time; and an image forming portion configured to form an image on the sheet-like member conveyed by the conveying portion driven by the drive control portion, wherein the control portion changes the setting time when the response time is longer than a first threshold that is set as a limit value at which a collision sound by deflection of the sheet-like member starts emanating, and when the response time is shorter than a second threshold that is set as a limit value, at which correction of inclination of the sheet-like member due to a stop of the conveying portion becomes insufficient and does not change the setting time when the response time is within an allowable range in which the response time is equal to or longer than the second threshold and is equal to or shorter than the first threshold.

10. The image forming apparatus according to claim 9, wherein the control portion shortens the setting time when the response time is longer than the first threshold.

11. The image forming apparatus according to claim 10, wherein the control portion shortens the setting time by a time difference between the response time and the first threshold.

12. The image forming apparatus according to claim 10, wherein the first threshold is an upper limit value of the allowable range for the response time.

13. The image forming apparatus according to claim 9, wherein the control portion extends the setting time when the response time is shorter than the second threshold.

14. The image forming apparatus according to claim 13, wherein the control portion extends the setting time by a time difference between the response time and the second threshold.

15. The image forming apparatus according to claim 13, wherein the second threshold is a lower limit value of the allowable range for the response time.

16. The image forming apparatus according to claim 9, wherein the control portion shortens the setting time when the response time is longer than the first threshold and extends the setting time when the response time is shorter than the second threshold.

* * * * *